United States Patent [19]

Santhouse et al.

[11] Patent Number: 4,797,533

[45] Date of Patent: Jan. 10, 1989

[54] ELECTRIC HAIR APPLIANCE HAVING AN IMPROVED HANDLE AND ACTUATING MECHANISM CONSTRUCTION

[75] Inventors: Daniel Santhouse, Stratford; Kevin E. Reeves, Trumbull, both of Conn.

[73] Assignee: Clairol Incorporated, New York, N.Y.

[21] Appl. No.: 929,023

[22] Filed: Nov. 7, 1986

[51] Int. Cl.[4] ..... H05B 3/00; A45D 1/04; A45D 2/36

[52] U.S. Cl. ..... 219/225; 132/9; 132/11 R; 132/31 R; 132/37 R; 132/85; 132/118; 132/212; 132/219; 132/231; 132/269; 219/222; 219/230; 219/240; 219/533

[58] Field of Search ..... 219/221-226, 219/230, 240, 533; 200/302.2; 132/37 R, 37 A, 31 R, 32 R, 7, 9, 11 R, 11 A, 85, 117, 118

[56] References Cited

U.S. PATENT DOCUMENTS

| | | | |
|---|---|---|---|
| 1,388,805 | 8/1921 | Dennis | 132/37 R |
| 2,213,649 | 9/1940 | Goodwin | 200/302.2 |
| 3,126,467 | 3/1964 | Stevens | 200/302.2 |
| 3,805,811 | 4/1974 | Dorn | 132/37 R |
| 3,946,196 | 3/1976 | Waters et al. | 219/222 |
| 4,101,757 | 7/1978 | Dyck et al. | 219/225 |
| 4,228,343 | 10/1980 | Kanner et al. | 219/225 |
| 4,354,092 | 10/1982 | Manabe et al. | 132/31 R |
| 4,366,365 | 12/1982 | Kunz et al. | 219/225 |
| 4,419,565 | 12/1983 | McGaw | 219/222 |
| 4,468,554 | 8/1984 | Andis | 219/222 |

*Primary Examiner*—Anthony Bartis
*Attorney, Agent, or Firm*—Gene Warzecha

[57] ABSTRACT

A hair appliance has a hair winding portion extending axially from the end of a handle covered by a flexible sleeve member adapted to be depressed in order to activate a movable part of the hair appliance. The hair appliance is of relatively uniform cross-section along its length and in the case of a curling iron provided with a hair retaining clip biased adjacent the barrel of the curling iron, the clip is provided with a longitudinal extension aligned with the body of the clip, with the extension overlying a recess in the handle and under the flexible sleeve member. The clip is opened by squeezing or depressing the flexible sleeve member to move the extension into the recess. In the case of a curling brush having a rotatable barrel, a similar construction results in the barrel locking mechanism being situated under the flexible sleeve member so that depression of the latter operates the locking mechanism. In the case of heatable appliances, an annularly visible indicating means is provided at the distal end thereof to indicate the power condition of the appliance.

11 Claims, 4 Drawing Sheets

ELECTRIC HAIR APPLIANCE HAVING AN IMPROVED HANDLE AND ACTUATING MECHANISM CONSTRUCTION

BACKGROUND OF THE INVENTION

1. FIELD OF THE INVENTION

The invention relates to hair curling appliances. In particular, the invention relates to electrically heated hair curling irons and brushes having a unique handle construction and actuating mechanism for controlling movable parts of such appliances.

2. DESCRIPTION OF THE PRIOR ART

Electrically heated hair appliances used for treating hair often take the form of curling irons such as represented by U.S. Pat. No. 4,366,365 (Kunz et al.) or curling brushes such as those represented by U.S. Pat. No. 4,329,567 (Kunz et al.). Both of the aforementioned patents are assigned to the assignee hereof. Such appliances generally have a handle, a hair winding portion attached to and axially aligned with the handle and a heating means within the hair winding portion for electrically heating it.

In the case of curling irons, the hair winding portion generally consists of a smooth (or flocked) cylindrical barrel having a spring biased, elongated, hair gripping or retaining clip pivotally mounted on the appliance. The clip has a hair retaining portion extending adjacent the barrel and on one side of a transverse pivot axis and an actuating lever or projection extending adjacent the handle on the other side of the pivot axis. In some cases, the projection is directly depressed radially inwardly to pivot the clip about its pivot axis, and in other cases the projection is pivoted indirectly by a user depressing an extra member which is itself in direct contact with the projection. The projection and all associated members to effect its motion will be referred to herein as a clip actuating mechanism.

In the case of hair curling brushes, the hair winding portion consists of a cylindrical base barrel having a plurality of bristles extending therefrom and the appliance may or may not be provided with means for rotating the hair winding portion relative to the handle. Also, rotatable curling brushes are known with and without latching devices for locking or preventing the rotation of the hair winding portion. A rotatable brush without a locking device is shown by U.S. Pat. No. 4,197,608 (Holley et al.). This device has a smooth handle provided with a layer of insulating material such as cork or foamed plastic. Rotatable brushes with locking devices are shown by U.S. Pat. Nos. 4,469,934 (Isshiki et al.), 4,314,137 (Dorn), 4,468,554 (Andis), each of which show locking devices generally radially protruding from the handle and which must be depressed to be activated, i.e. to lock or release the barrel. U.S. Pat. Nos. 4,023,578 (Buhler), 3,909,868 (Nogues) and Belgian Pat. No. 867,075 (Blitog) show rotatable curling brushes with sliding locking devices. These do not protrude from the handle quite so much as the devices shown in the previously mentioned patents. The various locking devices and members associated therewith to achieve proper operation are generally referred to herein as brush actuating mechanisms. The term is similar to that used with respect to curling irons to represent that both curling irons and rotatable curling brushes have moving parts activated by similar "actuating mechanisms".

Prior art curling irons and curling brushes which are provided with actuating mechanisms for actuating either the clip or the rotatable barrel latch have projecting actuating mechanisms which necessarily occupy a predetermined amount of space on the appliance and project beyond the cylindrical surface of the handle. Such projecting actuating mechanisms are adjacent the handle and therefore interfere with the user's rotation of the appliances about their axes, thereby making it difficult to wind hair on the hair winding portion. The protrusion of the actuating mechanisms also prevents hair near the scalp from being wound on the appliances. One example of an actuating projection which extends a fairly large distance above the surface of the handle is shown in U.S. Pat. No. 3,835,292 (Walter et al.), assigned to the assignee of the present invention. Even in those situations such as the aforementioned Pat. No. 4,366,365 which includes a relatively streamlined actuating mechanism, the handle must be made with a greater diameter in the area of the actuating mechanism in order to fit the mechanism in the handle. For example, the clip in this patent is shown to have an actuating projection horizontally aligned with the hair retaining portion. A cantilever spring element being an integral portion of the handle is situated over the clip projection—producing a greater handle size in this area—and is depressed in order to open the clip.

The handle of prior art curling irons and brushes must be a certain minimum length to be usable and comfortable to a user. To further provide a prior art actuating mechanism adjacent the handle of prior art curling irons and brushes makes the overall length of the devices greater than actually necessary to treat hair, thus making the appliances less convenient and more costly.

Another disadvantage of prior art hair curling appliances having projecting actuating mechanisms is that they are often awkward and difficult to use since the user's thumb (or other finger) must be raised, considerably in some cases, to reach the actuating mechanism. Also, since the surface of the actuating mechanism is radially removed from the handle, it is necessary to have the appliance and the user's hand in a specific relative orientation to enable the actuation of the actuating mechanism.

One other disadvantage associated with prior art hair appliances relates to the characteristics of the plastic material from which these devices are generally molded. Because the plastic must be hard enough to serve as a firm foundation to which other components are mounted, the handle is necessarily hard. This causes a less comfortable grip for the user in the course of turning the appliance to wind hair on the hair winding portion. In part, this is because the plastic surface is often not textured and has relatively little frictional resistance to the user's hand.

Still another disadvantage of prior art electrically operated hair appliances is their limitation in providing the user with an adequate indication of the "on/off" condition of the appliance. Such an indication is generally provided, if at all, by a single neon light, for example, visible only from a limited wiewing angle.

In view of the above, it is an object of this invention to provide a hair appliance which may be easily rotated and manipulated by a user. It is a further object to provide a hair curling appliance having a resilient and flexible handle.

It is another object of this invention to provide a hair appliance having a handle of uniform diameter. It is yet a further object of this invention to provide a hair curling appliance where the actuating mechanism is not radially projecting from the handle.

It is still another object of this invention to provide a hair appliance having an actuating mechanism which may be actuated with a user's hand being in a variety of orientations relative to the appliance.

It is yet another object of this invention to provide an electrically operated hair appliance having a power condition indicating means visible annularly relative to the axis of the appliance.

SUMMARY OF THE INVENTION

These and other objects of the invention are achieved by the preferred embodiment disclosed herein which comprises an improvement in a hair appliance having a handle, a hair winding portion having at least a part thereof movable relative to the handle and an actuating mechanism for effecting movement of said part, the improvement comprising said actuating mechanism having a predetermined portion thereof situated adjacent said handle, and a cylindrical resilient sleeve member covering a predetermined portion of said handle and said predetermined portion of said actuating mechanism, said sleeve member adapted to be depressed to actuate said actuating mechanism. In an embodiment of the invention for use in a curling iron, the curling iron comprises a handle having a recess, a cylindrical hair winding portion attached to and axially aligned with said handle, said hair winding portion comprising a barrel and a hair retaining clip pivotably biased adjacent said barrel, said clip having a longitudinal hair retaining portion biased against said barrel for retaining hair adjacent said barrel, and an actuating portion for being depressed to pivot said clip, said actuating portion situated adjacent said recess and adapted to be received therein, a resilient sleeve member covering said recess and adapted to be depressed in order to open said clip. In an electrically powered embodiment of the invention it comprises an annularly visible light at the distal end of the hair winding portion.

DESCRIPTION OF THE PREFERRED EMBODIMENT

Figures 1, 2, 3:
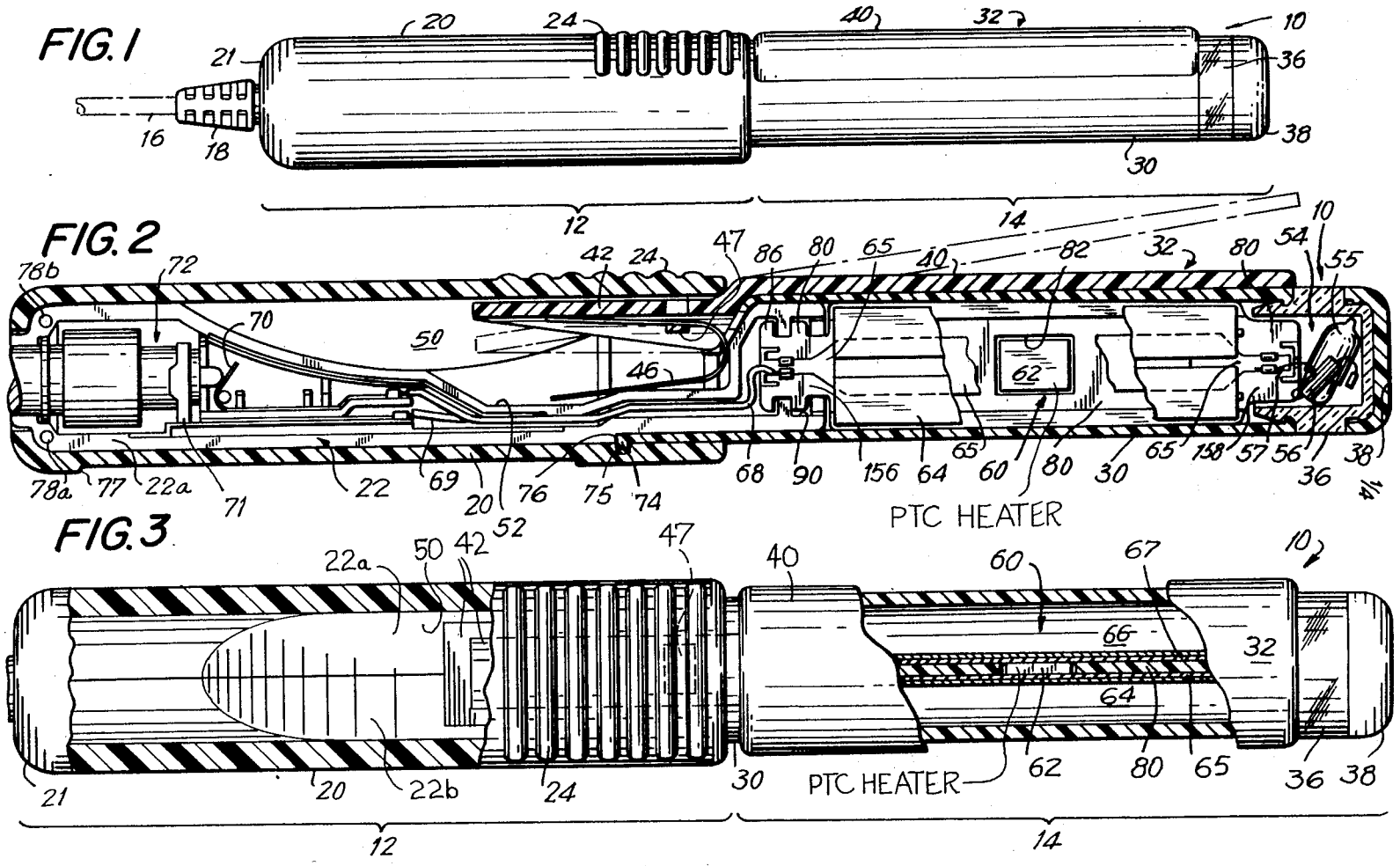
FIG. 1 is a side elevational view of a hair curling iron constructed in accordance with the principles of this invention.
FIG. 2 is a longitudinal cross-sectional view of FIG. 1.
FIG. 3 is a top plan view of FIG. 1 partially cutaway.
Figure 4A:
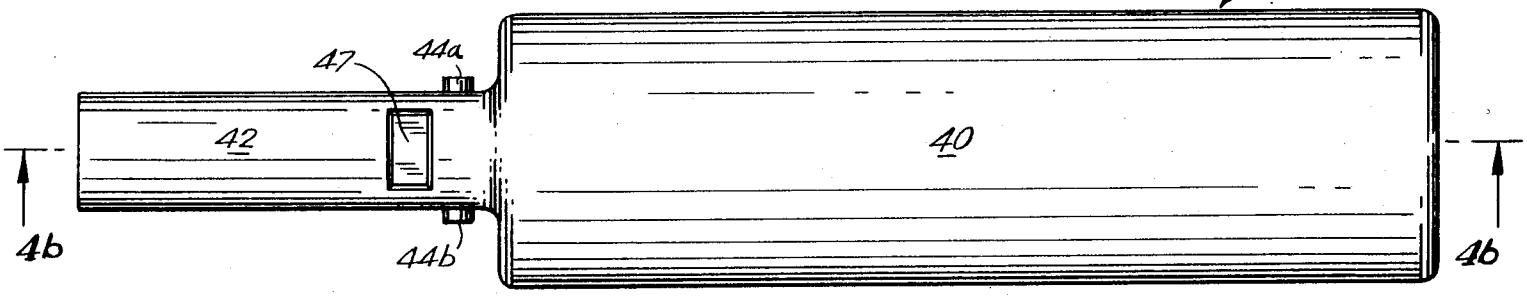
FIGS. 4*a* and 4*b* are top and cross-sectional views respectively of the hair retaining clip shown in FIG. 1.
Figure 4B:
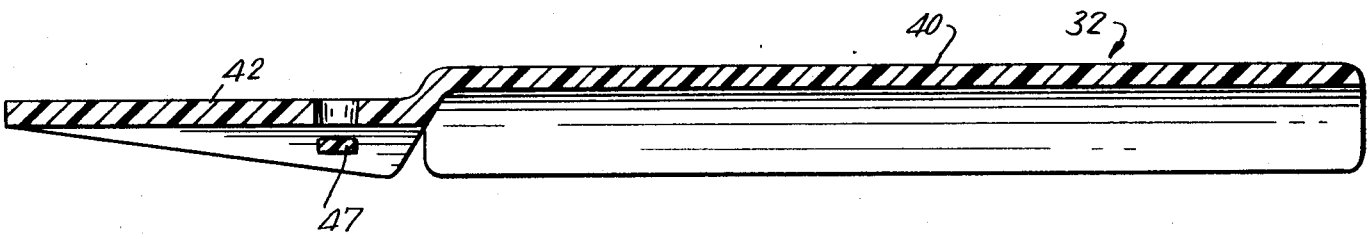
Figure 5A:
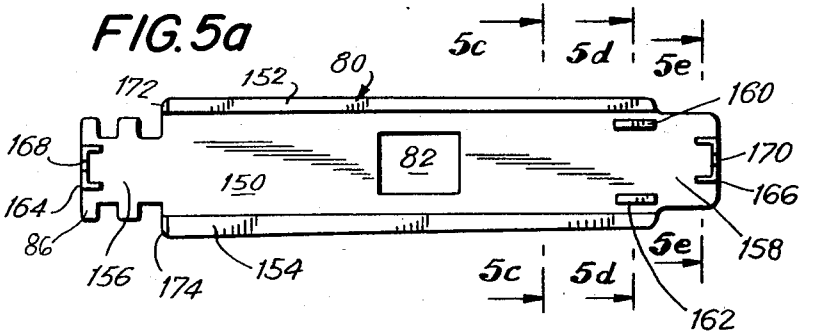
FIGS. 5*a* and 5*b* are plan and side elevational views of a portion of the invention.
Figure 5B:
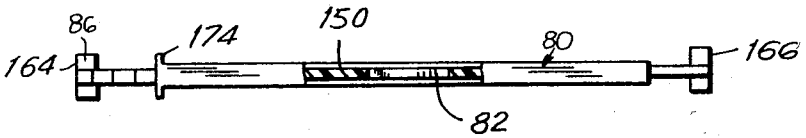
Figure 5E:
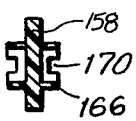
FIG. 5*e* is a sectional view of FIG. 5*a* taken along the line 5*e*—5*e.*
Figure 5D:
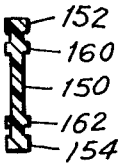
FIG. 5*d is a sectional view of FIG. 5a* taken along the line 5*d*—5*d;*
Figure 5C:
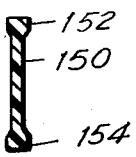
FIG. 5*c* is a sectional view of FIG. 5*a* taken along the line 5*c*—5*c;*

Referring now to FIGS. 1–3, there is shown a hair curling iron 10 having a cylindrical handle 12 and a cylindrical hair winding portion 14. Curling iron 10 is provided with a conventional electrical two wire cord 16 and strain relief 18 in order to provide electrical power to a heating means 60 within hair winding portion 14, as will be understood below. The invention enables the diameter of handle 12 to be uniform and substantially equal to the diameter of hair winding portion 14. In the preferred embodiment there is a slight step at the junction of the surfaces of handle 12 and hair winding portion 14 such that the outer surface of the hair retaining clip 32 (described below) is generally aligned with the outer surface of handle 12. Unlike the prior art, the invention eliminates clip actuating projections such that all portions of the surface of curling iron 10 are at substantially the same radial distance from the longitudinal axis of the curling iron.

Handle 12 comprises a resilient or flexible covering sleeve 20 which fits over the handle body portion 22 (best seen in FIG. 2) of handle 12. Sleeve 20 is provided with index 24 for identifying a predetermined portion of the sleeve member as will be better understood below. In the preferred embodiment, index 24 is in the form of raised ribs on the outer surface of sleeve 20. This provides a tactile as well as visual indication, although it will be understood that other indicia may be used such as colored or textured marks, etc. Sleeve 20 is generally uniformly cylindrical although the rear end 21 of sleeve 20 (adjacent strain relief 18) tapers down to a diameter smaller than the main portion of the sleeve body. If desired, sleeve 20 could be a uniformly dimensioned cylindrical sleeve in which event a portion of body portion 22 adjacent strain relief 18 could be visible. Any suitable means of attaching sleeve 20 to body portion 22 may be used (e.g. friction fit, appropriate adhesives, etc.). Sleeve 20 is made of soft, pliable elastomeric material such as polyvinyl chloride and may be made with a variety of predetermined textured characteristics. As will be understood by those skilled in the art, sleeve 20 must be sufficiently flexible to enable it to be squeezed or depressed enough to activate underlying associated activating mechanisms. In the preferred embodiment, sleeve 20 has generally cylindrical interior and exterior surfaces in order to conform to the cylindrical shape of body portion 22 and provide a cylindrical surface for the user to grip. The interior and exterior surfaces of sleeve 20 may be shaped differently, it being understood that any shape suitable for enabling squeezing or depressing of the sleeve in the area of the activating mechanism is within the scope of the invention. Indeed, only the portion of sleeve 20 adjacent the actuating mechanism needs to be flexible.

Hair winding portion 14 comprises a plastic cylindrical barrel 30, a hair retaining clip 32 having an inwardly facing partially cylindrical surface to conform to the cylindrical surface of barrel 30 in a conventional manner, a clip actuating mechanism, an annular translucent or transparent light window 36 and an end cap 38. While a portion of clip 32 and actuating mechanism are on the handle side of the juncture of the handle and the hair winding portion, they are for present purposes deemed to be a portion of the latter to simplify explanation of the invention.

Referring now to FIGS. 2, 3, 4*a* and 4*b*, the internal construction of curling iron 10 and the operation of clip 32 will be better understood. It will be noted that clip 32 has a longitudinal hair retaining portion 40 and an actuating projection 42 longitudinally aligned and integrally formed therewith. In the preferred embodiment projection 42 is slightly offset radially inwardly from portion 40. Clip 32 is provided with a pair of transverse pivot pins 44*a* and 44*b* intermediate portions 40 and 42 for engaging pivot recesses (not shown) molded into the handle body portion 22. The clip actuating mechanism comprises a leaf spring 46 which is tensioned between the bottom of body portion 22 and the bottom of projection 42 and serves to bias clip 32 against barrel 30. Spring 46 is held in place adjacent projection 42 by a retaining bar 47 molded into the clip.

It will be understood that inward movement or depression of flexible sleeve 20 in the area of index 24 will cause clip 32 to pivot. Body portion 22 is provided with a recess 50 extending sufficiently below the cylindrical interior surface of sleeve 20 so that projection 42 may be received therein as clip 32 is pivoted on transverse pins 44*a* and 44*b*. As used herein, the term recess includes the space bonded by the aperture (top of the recess) in the surface of the handle and any internal surface of the handle facing the space. Recess 50 has a bottom surface 52 which limits the motion of projection 42 and serves as the top of a generally longitudinally extending channel which not only protects the components in the interior of body portion 22 but also serves to protect the user from exposure to uninsulated live electrical components in the event sleeve 20 tears or is otherwise removed. In the preferred embodiment, body portion 22 is formed of two compatible halves 22*a* and 22*b* in order to facilitate assembly and enable the molding of internal structure. The interior of body portion 22 is an insulating electrical enclosure. Recess 50 must be sufficiently large both longitudinally and transversely to enable sleeve 20 to be flexed inwardly enough to fully depress actuating projection 42 without unduly stressing the sleeve.

Annular light window 36 is axially aligned with barrel 30 at a point distal from handle 12. A light assembly 54 comprising neon light 55 and suitable resistor 56 is connected via wires 57 to electrically conducting portions of the heating means 60 in order to turn the light on when the heating means is turned on. The interior of window 36 may be a faceted surface to enhance light refraction. The annular nature of window 36 provides a visual indication of the power condition of the appliance from substantially all viewpoints.

Heating means 60 comprises a positive temperature coefficient (PTC) heater 62 sandwiched between two C-shaped aluminum heat sinks 64 and 66 in a conventional manner. Two parallel electrode 65 and 67 are interposed between PTC 62 and heat sinks 64 and 66, respectively, and are connected via crimp terminals and wires 68 and 69 to electrical contact members 70 and 71. Contacts 70 and 71 are connected in a conventional manner to swivel connector 72 which is operatively connected to the end of two wire cord 16. Wires 68 and 69 are run in the channel under bottom surface 52 of recess 50. Electrodes 65 and 67 also serve as bus bars to power light assembly 54.

The assembly of curling iron 10 is facilitated and made more economical by separating hairwinding portion 14 from the handle and electrical subassembly. This also facilitates manufacture of hair appliances having a variety of hair winding portions which may be attached to a common handle. For example, the hair winding portion may be in the form of a curling brush rather than a curling iron, both having a commonly dimensioned barrel to fit the remaining components. The assembly of the handle, its internal electrical components and heater assembly 60 (described below) as a unit enables barrel 30 to be subsequently slipped over heater 60 and snapped into the handle body portion. The barrel and handle body portion are held together by conventional locking tabs and associated apertures molded into the parts. Sleeve 20 may then be slipped over the handle body portion (and actuating projection 42 if a curling iron is being made) and oriented via molded keys (not shown). The orientation properly positions index 24. The connection of sleeve 20 to the handle body portion is made secure by providing an annular flange 74 at one end of barrel 30, the flange being received within an annular channel 75 on the inside of sleeve 20 and being adjacent an annular ridge 76 on the surface of handle body portion 22. Sleeve 20 may be provided with a slightly recessed area 77 in which labelling and identifying information may be embossed.

The manufacture of the appliance is facilitated by the use of a spacer 80 interposed between heat sinks 64 and 66 and having an aperture 82 for receiving PTC heater 62 therein. Spacer 80 is made of a suitable insulating material and is preferably molded in order to facilitate the shaping of various features as will be more fully explained below. Spacer 80, best seen in FIGS. 5*a*–5*e*, is further provided with a shaped end portion 86 intended for mating with complementarily shaped aperture 90 formed in both halves 22*a* and 22*b* of handle body portion 22. The two halves 22*a* and 22*b* when joined in a conventional manner retain spacer 80 firmly therebetween. Spacer 80 in turn holds all components of heater 60 attached to it to form a subassembly which may then be attached to handle halves 22*a* and 22*b* via end portion 86. Alternatively, handle body portion 22 and barrel 30 may be made as one integral piece with the other components suitably inserted therein.

Referring to FIGS. 5*a*–5*e*, it will be noted that spacer 80 is symmetrical and it will be understood that, for simplification, only the features of one side will be described. Spacer 80 comprises a recessed channel 150 extending lengthwise between two opposed platform edges 152 and 154. Edges 152 and 154 insure sufficient insulating clearance between the heat sinks, provide spacing between the heat sinks to avoid bending the electrodes and serve as adhesive bearing surfaces for receiving a longitudinal insulating tape strip over the electrode in certain embodiments requiring double insulation. Aperture 82 for receiving PTC 62 is situated in the middle of channel 150. Edges 152 and 154 are approximately as long as heat sinks 64 and 66 (best seen in FIG. 2) and the width of spacer 80 is decreased at each end 156 and 158. As shown in FIG. 2, the decreased width of end 158 facilitates minimizing the length of hair winding portion 14 and the overall appliance by enabling light window 36 to be overlappingly attached to barrel 30. Similarly, the narrow width of end 156 facilitates minimizing the length of the appliance by providing overlapping attachment of end 156 to handle body portion 22. The extension of the narrow ends 156 and 158 beyond the body of the spacer also serves to separate the crimp connections from the heat sinks and facilitates mechanical connection of components on the inside of the barrel ends.

Spacer 80 comprises a pair of positioning ribs 160 and 162 adjacent end 158 for locating electrode 65. Positioning ribs for the other end of the electrodes may be molded into handle body portions 22*a* and 22*b* (not shown). Three-sided positioning ribs 164 and 166 are situated adjacent ends 156 and 158, respectively, in order to retain electrode 65 both laterally and longitudinally during assembly. Each rib 164 and 166 is provided with a wire clearance aperture 168 and 170 for receiving wires 68 and 57, respectively. Spacer 80 further comprises a pair of heat sink retaining tabs 172 and 174 at one end of edges 152 and 154, respectively. As the barrel is slid over heater 60 during assembly these stops limit heat sink motion.

Spacer 80 is shaped to enable its use in a variety of hair appliance designs. For example, channel 150 is provided to serve as an electrical enclosure in double insulated versions of hair appliances. That is, when an insulating tape (not shown) is applied to the heat surface on and between edges 152 and 154, and extends beyond the edges to adhere to the spacer, the electrical components (PTC and electrodes) are totally within the enclosure.

The advantages of the invention are achieved by having the handle diameter substantially equal to the barrel diameter and by having the clip actuating projection be, upon actuation, received in a recess in the handle. While the preferred embodiment shows a hair curling iron with a flexible sleeve member covering the entire handle and the recess, it will be understood that many variations are possible. For example, the sleeve member need not be entirely flexible; since it is only necessary for the portion overlying the actuating projection to flex, the remainder of the sleeve may be relatively inflexible. Also, since the handle body portion is an electrically insulated enclosure, the flexible sleeve member need not be used at all. Alternatively, the flexible sleeve member may have an aperture in registry with the handle recess and the actuating projection may fill this aperture in the normal position such that the surface of the projection is aligned with the surface of the handle. If a resilient grip is desired without providing for flexing of the sleeve material over the recess, the sleeve may have an aperture in registry with the handle aperture and the actuating projection may have an intermediate layer of some desired material (resilient or otherwise) in order to bring the surface of the actuating projection up to the surface of the sleeve.

Figure 6:
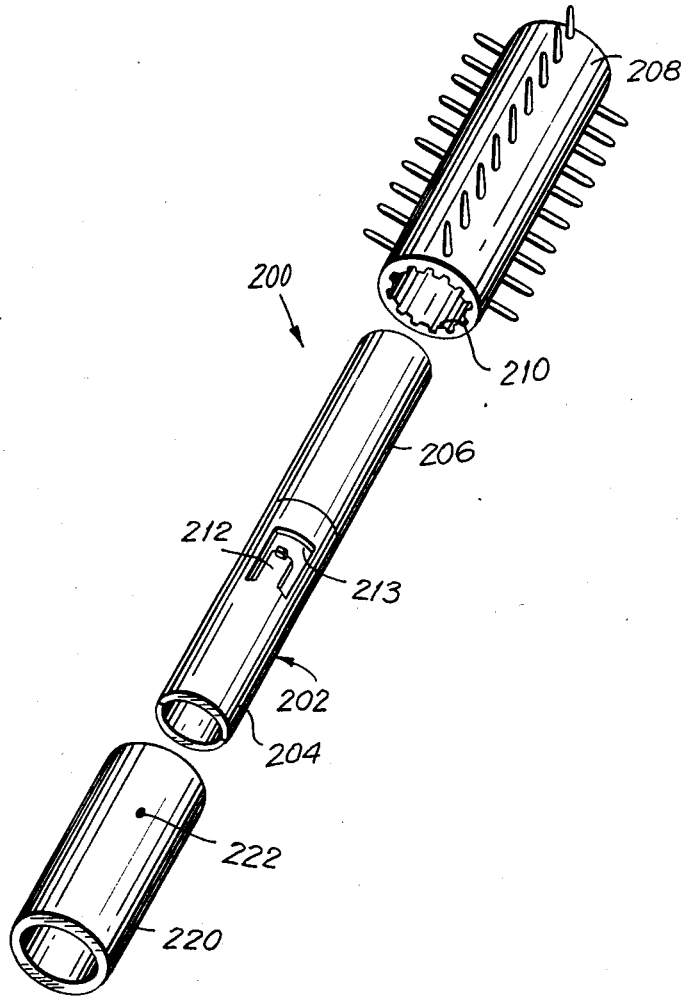
FIG. 6 is an exploded diammetrical view of a curling brush constructed in accordance with the principles of this invention.

Referring now to FIG. 6, there is shown a diagrammatic exploded view of a hair curling brush constructed in accordance with the principles of this invention. While brush 200 may be heated and may have an annular light means as described above, all power, heating and lighting components are omitted for clarity. Brush 200 includes a cylindrical base 202 having a handle portion 204 and a hair winding support portion 206. Portion 206 is designed to support a rotatable brush member 208 having notches 210 or other suitable locking devices. Notches 210 are intended to operate in conjunction with pivotable latching member 212 formed in handle portion 204. Latching member 212 is adapted to be received within recess 213. Brush 200 is further provided with a resilient, flexible sleeve member 220 for covering handle portion 204, sleeve member 220 is provided with indicating mark 222 for indicating where it must be depressed to cause latching member 212 to engage (or disengage) notches 210.

It will be understood by those skilled in the art that numerous improvements and modifications may be made to the preferred embodiment disclosed herein without departing from the spirit and scope thereof.

What is claimed is:

1. In a hair appliance having a cylindrical handle, an elongated hair winding portion connected to an end of said handle and having at least a part thereof movable relative to said handle and said hair winding portion, an actuating mechanism for enabling movement of said movable part, said actuating mechanism including a movable surface, said hair appliance further having a bias means for biasing said actuating mechanism to a predetermined position, the improvement comprising:

said handle having a cylindrical external surface at a predetermined radial distance from the longitudinal axis of said handle, said surface being indented over a predetermined longitudinal length and predetermined arcuate extent to form a recess in said external surface, said actuating mechanism having said movable surface thereof overlying said recess and substantially aligned at said predetermined radial distance with the cylindrical external surface of said handle when said actuating mechanism is biased to said predetermined position, said movable surface being radially inwardly movable relative to said handle and adapted to be received, upon radially inward movement thereof, in said recess, and a cylindrical flexible sleeve member covering a predetermined portion of said recess and said handle and at least part of said movable surface of said actuating mechanism, that part of said sleeve member covering said movable surface of said actuating mechanism being adapted to be flexed radially inwardly to move said actuating mechanism against said bias means and into said recess within said external surface of said handle, said recess being sufficiently large to enable said flexible sleeve member to be deformed inwardly a sufficient amount to enable adequate radially inward movement of said actuating mechanism without unduly stressing sad sleeve.

2. An appliance according to claim 1 wherein sad appliance is a curling iron and said movable part is a pivotable hair retaining clip having a longitudinally extending hair retaining portion overlying the exterior surface of said hair winding portion and wherein said movable surface of said actuating mechanism is a longitudinal extension of said longitudinally extending hair retaining portion and is substantially aligned therewith.

3. An appliance according to claim 2 wherein said extension is radially inwardly offset from said hair retaining portion.

4. An appliance according to claim 1 further comprising an index on the portion of said sleeve member covering said movable surface of said actuating mechanism for indicating where it should be flexed to move said actuating mechanism.

5. An appliance according to claim 1 further comprising electric heating means within said hair winding portion and means for energizing to said heating means from a power source.

6. An appliance according to claim 5 further comprising:

an indicating means on said hair winding portion operatively connected to said energizing means for indicating the power condition of said appliance, said indicating means annularly visible relative to the longitudinal axis of said hair winding portion.

7. An appliance according to claim 5 wherein said energizing means includes an electrical power input at the other end of said handle and said handle has a channel extending longitudinally between said one end and the other end, said channel containing electrical components within said handle connecting said heating means to said power input.

8. A hair appliance comprising:

an elongated handle having a cylindrical external surface at a predetermined radial distance from the longitudinal axis of said handle, said surface being indented over a predetermined longitudinal length and predetermined arcuate extent to form a recess in such external surface;

an elongated hair winding portion attached to and axially aligned with one end of said handle, said hair winding portion comprising a barrel, a pivotable hair retaining clip and a means for biasing said clip toward said barrel, said clip having a longitudinal hair retaining portion pivotably biased against said barrel by said biasing means for retaining hair adjacent said barrel and an actuating portion for being depressed radially inwardly to pivot said clip, said actuating portion overlying said recess and having its surface substantially aligned at said predetermined radial distance with said external surface of said handle when said clip is biased against said barrel, said actuating portion being adapted to be received within said recess; and a flexible member covering a predetermined portion of said recess and said handle and at least part of said actuating portion and adapted to be radially inwardly flexed in order to move said actuating portion radially inwardly into said recess to thereby pivot said clip to an open position, said recess being sufficiently large to enable said flexible member to be deformed inwardly a sufficient amount to enable adequate radially inward movement of said actuating portion without unduly stressing said flexible member.

9. An appliance according to claim 8 wherein said handle and flexible member are substantially cylindrical and wherein the outside diameter of said flexible member is uniform along the length thereof.

10. An appliance according to claim 8 wherein the outside diameters of said handle and said barrel are the same.

11. An elongated hair appliance comprising:

an elongated cylindrical handle having a recess in the outer surface thereof;

an elongated hair winding portion attached to and axially aligned with an end of said handle, said hair winding portion comprising a barrel, a pivotable hair retaining clip and a means for biasing said clip, said clip having a longitudinal hair retaining portion pivotably biased to a closed position against said barrel by said biasing means for retaining hair adjacent said barrel and an actuating portion overlying said recess for being depressed to pivot said clip, said actuating portion having its outer surface substantially aligned with the outer surface of said handle when said hair retaining portion is biased against said barrel and adapted to be received within said recess when depressed; and a generally cylindrical cover received on said handle, said cover having a flexible portion adapted to be situated over said actuating portion and said recess whereby flexing of said flexible portion radially inwardly toward the longitudinal axis of said handle will cause said hair retaining clip to pivot to an open position, said recess being sufficiently large to enable said flexible member to be deformed inwardly a sufficient amount to enable adequate radially inward movement of said actuating portion without unduly stressing said flexible member.

* * * * *